US009919532B2

(12) United States Patent
Seo et al.

(10) Patent No.: US 9,919,532 B2
(45) Date of Patent: Mar. 20, 2018

(54) INKJET-HEAD CLEANING DEVICE AND METHOD

(71) Applicant: QUALICAPS CO., LTD., Yamatokoriyama-shi, Nara (JP)

(72) Inventors: Masahiro Seo, Yamatokoriyama (JP); Yoshihisa Konishi, Yamatokoriyama (JP); Tetsuhisa Ishida, Yamatokoriyama (JP); Motohiro Yagyu, Yamatokoriyama (JP)

(73) Assignee: QUALICAPS CO., LTD., Yamatokoriyama-shi, Nara (JP)

( * ) Notice: Subject to any disclaimer, the term of this patent is extended or adjusted under 35 U.S.C. 154(b) by 0 days.

(21) Appl. No.: 15/124,805

(22) PCT Filed: Mar. 2, 2015

(86) PCT No.: PCT/JP2015/056031
§ 371 (c)(1),
(2) Date: Sep. 9, 2016

(87) PCT Pub. No.: WO2015/146494
PCT Pub. Date: Oct. 1, 2015

(65) Prior Publication Data

US 2017/0021630 A1 Jan. 26, 2017

(30) Foreign Application Priority Data

Mar. 28, 2014 (JP) ..... 2014-068611

(51) Int. Cl.
*B41J 25/00* (2006.01)
*B41J 2/165* (2006.01)
(Continued)

(52) U.S. Cl.
CPC ..... *B41J 2/16544* (2013.01); *B41J 2/16508* (2013.01); *B41J 25/001* (2013.01);
(Continued)

(58) Field of Classification Search
CPC ... B41J 2/16544; B41J 2/16508; B41J 25/001
See application file for complete search history.

(56) References Cited

U.S. PATENT DOCUMENTS 5,206,666 A 4/1993 Watanabe et al.
2002/0135633 A1 9/2002 Ansell et al.
(Continued)

FOREIGN PATENT DOCUMENTS

JP 2002-178529 A 6/2002
JP 2003-175594 A 6/2003
(Continued)

OTHER PUBLICATIONS

English Translation of International Search Report of PCT/JP2015/056031.
(Continued)

*Primary Examiner* — Jason Uhlenhake
(74) *Attorney, Agent, or Firm* — Muncy, Geissler, Olds & Lowe, P.C.

(57) ABSTRACT

An inkjet head cleaning apparatus 1 that moves an inkjet head 10 from a printing position P1 to a cleaning position P2 to perform cleaning, the inkjet head cleaning apparatus 1 comprising a conveying means 20 for conveying the inkjet head 10 between the printing position P1 and the cleaning position P2 and a cleaning means 30 for cleaning a discharge surface 12 of the inkjet head 10 conveyed to the cleaning position P1, wherein the conveying means 20 changes the orientation of the inkjet head 10 such that the orientation of the discharge surface 12 of the inkjet head 10 is different in the printing position P1 and in the cleaning position P2.

7 Claims, 5 Drawing Sheets

(51) Int. Cl.
*B41J 25/316* (2006.01)
*B41J 25/34* (2006.01)

(52) U.S. Cl.
CPC ..... *B41J 25/316* (2013.01); *B41J 25/34* (2013.01); *B41J 2002/1655* (2013.01)

(56) References Cited

U.S. PATENT DOCUMENTS

| | | | |
|---|---|---|---|
| 2003/0049178 | A1 | 3/2003 | Kiene et al. |
| 2005/0285888 | A1 | 12/2005 | Haney et al. |

FOREIGN PATENT DOCUMENTS

| | | | | |
|---|---|---|---|---|
| JP | 2003175594 | A | * | 6/2003 |
| JP | 2008-188806 | A | | 8/2008 |
| JP | 2012-020230 | A | | 2/2012 |
| JP | 2012020230 | A | * | 2/2012 |
| JP | 2012-158083 | A | | 8/2012 |
| JP | 2012158083 | A | * | 8/2012 |

OTHER PUBLICATIONS

English Translation of Written Opinion of the International Searching Authority for PCT/JP2015/056031.
The supplemental European Search Report of EP corresponding application No. EP15769992 dated Nov. 3, 2017.

* cited by examiner

INKJET-HEAD CLEANING DEVICE AND METHOD

TECHNICAL FIELD

The present invention relates to an inkjet head cleaning apparatus and a method and, more specifically, an inkjet head cleaning apparatus and a method by which an inkjet head is moved from a printing position to a cleaning position to perform cleaning.

BACKGROUND ART

An inkjet head has a large number of nozzles, and a desired marking can be formed on the surface of printing substrates such as tablets by suitably selecting the nozzles to be used to discharge ink. Since there is a risk that the discharge surface of an inkjet head collects some of the discharged ink and foreign matter such as dust of printing-substrate tablets, long-term continuous use is likely to result in discharge failure, and therefore cleaning apparatuses for cleaning the discharge surface of an inkjet head have been researched to date.

For example, the inkjet head cleaning apparatus disclosed in Patent Literature 1 comprises a head cleaning part where an inkjet head can be positioned by horizontally moving the inkjet head. The head cleaning part comprises a cleaning agent discharge part, an air discharge part, and a suction part inside a covering that covers the inkjet head, and can perform cleaning by discharging a cleaning agent from the cleaning agent discharge part onto the discharge surface of the inkjet head, then blowing air from the air discharge part to blow away the cleaning agent and dissolved ink, and sucking such waste fluid with the suction part.

CITATION LIST

Patent Literature

Patent Literature 1: JP 2002-178529A

SUMMARY OF INVENTION

Technical Problem

While the above-described conventional cleaning apparatus can suppress discharge failure resulting from the clogged nozzles and grimed discharge surface of an inkjet head, there is a risk that bubbles generated in the ink path and nozzles of the inkjet head during printing are not removed to the outside even during cleaning and remain, and that the discharge failure problems still exist.

Accordingly, an object of the present invention is to provide an inkjet head cleaning apparatus and a method that are capable of reliably preventing the discharge failure of an inkjet head.

Solution to Problem

The foregoing object of the present invention is achieved by an inkjet head cleaning apparatus that moves an inkjet head from a printing position to a cleaning position to perform cleaning, the inkjet head cleaning apparatus comprising:

a conveying means for conveying the inkjet head between the printing position and the cleaning position; and a cleaning means for cleaning a discharge surface of the inkjet head conveyed to the cleaning position, wherein the conveying means changes the orientation of the inkjet head such that the orientation of the discharge surface of the inkjet head is different in the printing position and in the cleaning position.

It is preferable that in this inkjet head cleaning apparatus, the conveying means supports the inkjet head such that the discharge surface faces obliquely downward in the printing position and vertically downward in the cleaning position.

It is preferable that the conveying means supports the inkjet head in a horizontally movable manner and also in a rotatable manner. In this configuration, it is preferable that the conveying means rotates the inkjet head 45 degrees or greater while horizontally moving the inkjet head from the printing position to the cleaning position. It is preferable that the washing means comprises a scraping member with which the discharge surface is capable of coming into contact, and with the scraping member being in contact with the discharge surface after cleaning, it is possible to scrape off a deposit on the discharge surface by horizontally moving the inkjet head.

It is preferable to further comprise a storage means comprising an absorber impregnated with a storage solution, and it is preferable that the conveying means conveys the inkjet head to a storage position to bring the discharge surface into contact with the absorber of the storage means. In this configuration, it is preferable that the absorber has a recess in center, and it is preferable that the recess is tightly closed by bringing a portion surrounding the recess into contact with the discharge surface.

Moreover, the foregoing object of the present invention is achieved by an inkjet head cleaning method by which an inkjet head is moved from a printing position to a cleaning position to perform cleaning, the method comprising:

a conveying step of conveying the inkjet head between the printing position and the cleaning position; and a cleaning step of cleaning a discharge surface of the inkjet head conveyed to the cleaning position, wherein in the conveying step, the orientation of the inkjet head is changed such that the orientation of the discharge surface of the inkjet head is different in the printing position and in the cleaning position.

Advantageous Effects of Invention

The present invention can provide an inkjet head cleaning apparatus and a method that are capable of reliably preventing the discharge failure of an inkjet head.

DESCRIPTION OF EMBODIMENTS

Figure 1:
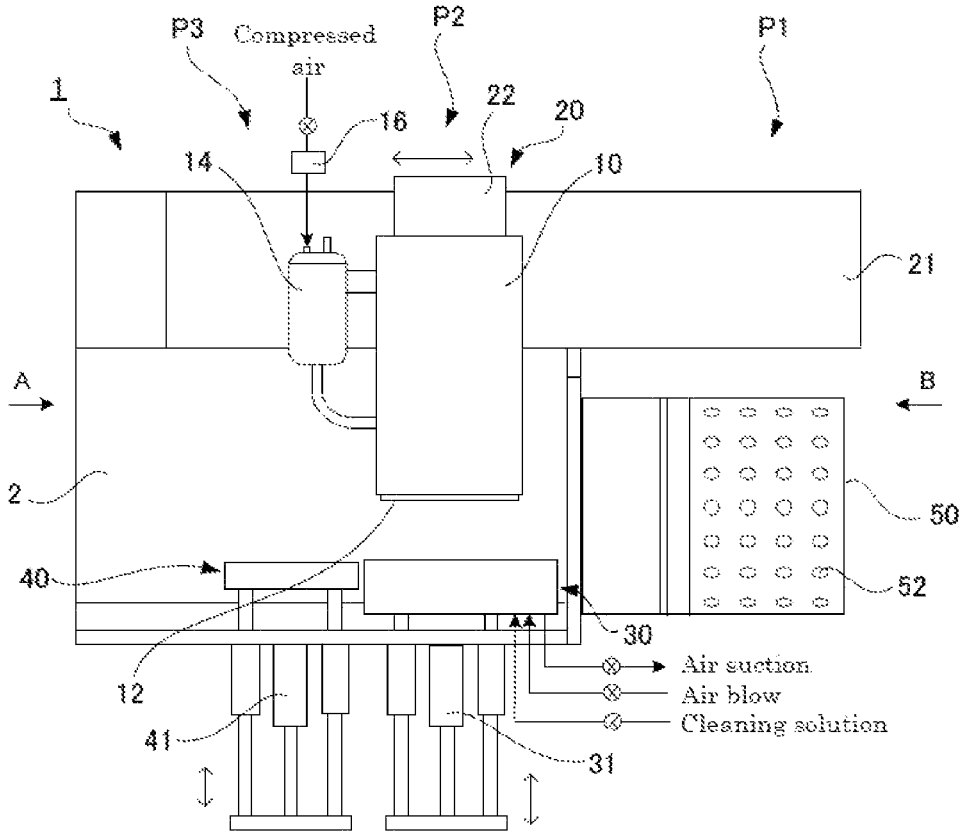
FIG. 1 is a front view of an inkjet head cleaning apparatus according to one embodiment of the present invention.
Figure 2:
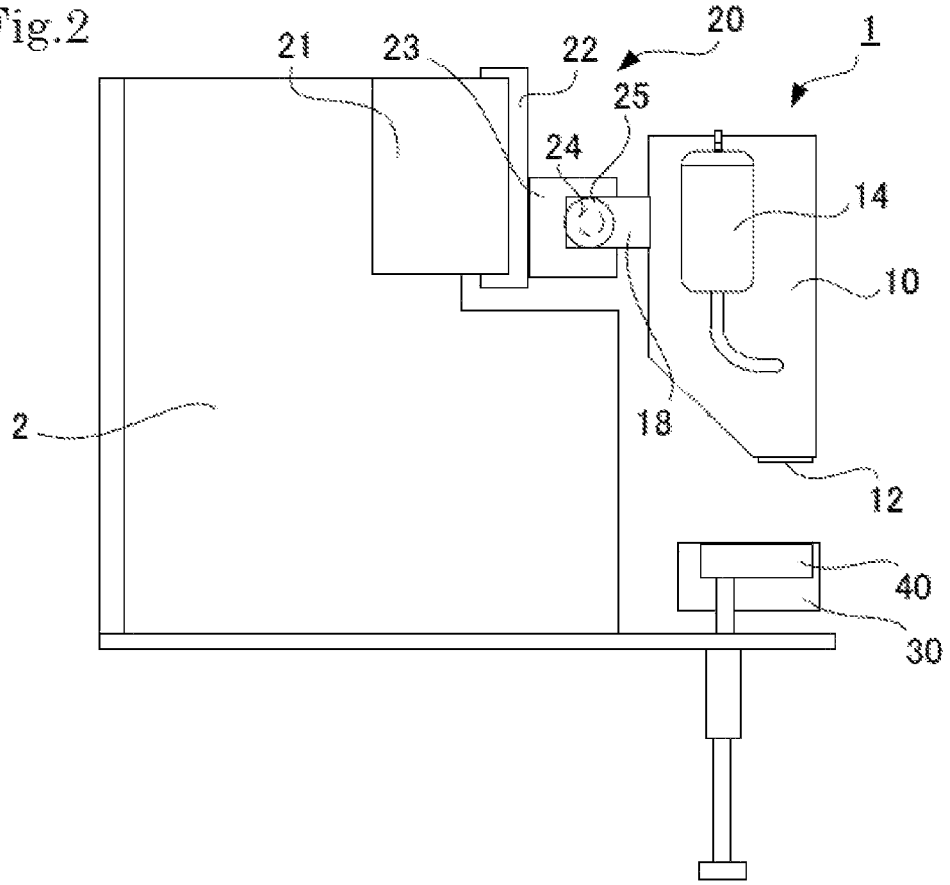
FIG. 2 is a side view of the inkjet head cleaning apparatus shown in FIG. 1 as viewed in the direction of arrow A.

Below, an embodiment of the present invention will now be described with reference to the attached drawings. FIG. 1 is a front view of an inkjet head cleaning apparatus according to one embodiment of the present invention, and FIG. 2 is a side view of the inkjet head cleaning apparatus shown in FIG. 1 as viewed in the direction of arrow A. As shown in FIGS. 1 and 2, an inkjet head cleaning apparatus 1 comprises a conveying device 20 for conveying an inkjet head 10, a cleaning device 30 for cleaning the discharge surface of the inkjet head 10, and a storage tool 40 for storing the inkjet head 10. These components are supported by a support member 2, and their operations are controlled by a control device that is not shown.

The inkjet head 10 comprises an ink tank 14 for supplying ink, and the distal end surface of a nozzle plate having a large number of nozzles serves as the discharge surface 12. While ink supplied to an incorporated ink supply path is returning back to the ink tank 14 via an ink removal path, the inkjet head 10 discharges ink from the discharge surface 12 due to the operation of a piezoelectric element provided for each nozzle. Ink is supplied from the ink tank 14 to the discharge surface 12 by sending compressed air from a compressed air supply source connected via a regulator 16. A pair of attachment arms 18, 18 are provided on the back surface side of the inkjet head 10.

The conveying device 20 has a linear guide mechanism comprising a slider 22 capable of reciprocating along a horizontally placed guide rail 21. A bracket 23 is fixed to the surface of the slider 22, and the arms 18, 18 are rotatably attached to the bracket 23 via a rotating shaft 24. The rotating shaft 24 is driven by a servomotor 25 such that the inkjet head 10 arrives at a predetermined rotational orientation.

Having the above-described configuration, the conveying device 20 supports the inkjet head 10 in a horizontally movable manner and also in a rotatable manner. As shown in FIG. 1, a printing position P1, a cleaning position P2, and a storage position P3 are set as positions to which the inkjet head 10 is horizontally conveyed. The rotation of the inkjet head 10 is controlled such that the inkjet head 10 arrives at desired orientations in the positions P1 to P3.

Figure 3:
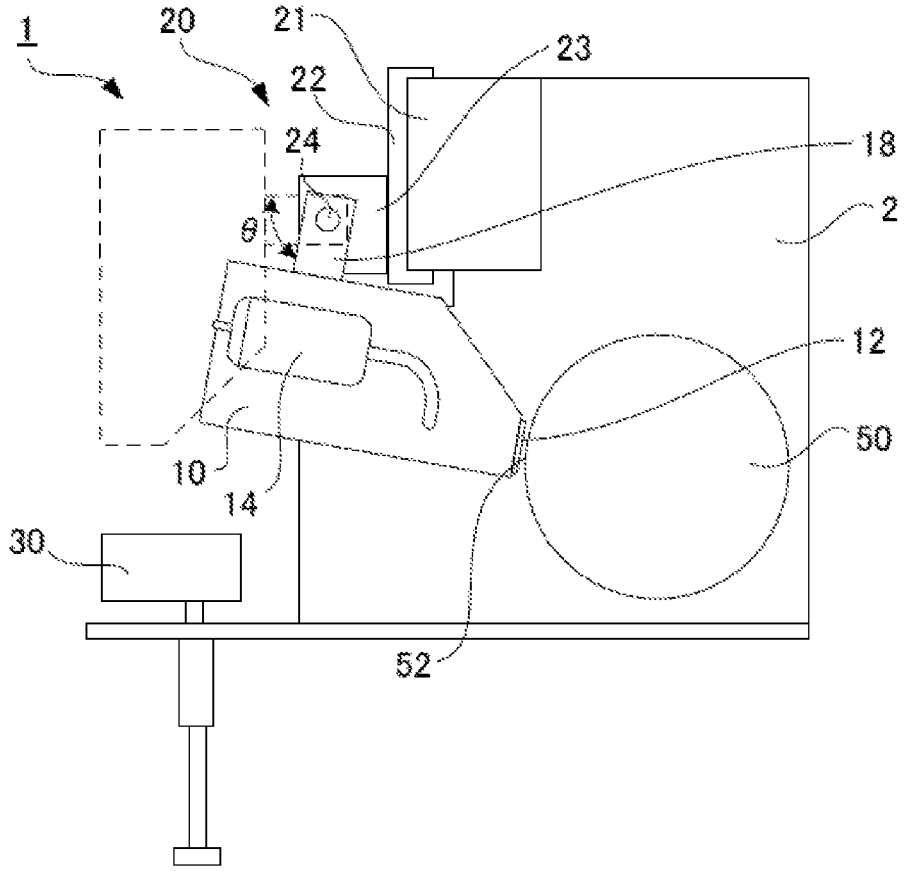
FIG. 3 is a side view of the inkjet head cleaning apparatus shown in FIG. 1 in another state as viewed in the direction of arrow B.

Near the printing position P1, a marking drum 50 is placed that has holding parts 52 for holding printing substrates such as tablets and capsules in the outer circumferential surface. FIG. 3 is a side view of the inkjet head cleaning apparatus shown in FIG. 1 as viewed in the direction of arrow B, and shows a state where the inkjet head 10 is in the printing position P1. As shown in FIG. 3, the discharge surface 12 of the inkjet head 10 near the outer circumferential surface of the marking drum 50 faces obliquely downward to face the holding parts 52, and the inkjet head 10 is retained in a tilted orientation. The inkjet head 10 forms a predetermined marking pattern by inkjet printing on printing substrates that are supplied from an unshown supplying means and held in the holding parts 52 of the marking drum 50.

Although the orientation of the inkjet head 10 in the printing position P1 is not necessarily limited to an orientation that causes the discharge surface 12 to face obliquely downward, it is preferable that the discharge surface 12 faces more downward relative to the horizontal direction because with an orientation that causes the discharge surface 12 to face upward, dust of tablets and such printing substrates as well as ink floating around in a mist or liquid form are likely to be collected and remain on the discharge surface 12. In the present embodiment, the printing orientation of the inkjet head 10 is set such that the angle between the direction of ink discharged from the discharge surface 12 and the horizontal direction is about 5 degrees.

When the inkjet head 10 needs to be cleaned, for example, after a pre-set number of printing substrates are printed, the inkjet head 10 is conveyed to the cleaning position P2 shown in FIG. 1 due to the operation of the conveying device 20. At this time, the conveying device 20 horizontally conveys the inkjet head 10 along the guide rail 21 and also rotates the inkjet head 10 to cause the inkjet head 10 to stand upright so that the discharge surface 12 faces vertically downward.

Bubbles may be generated in the ink path in the inkjet head 10 due to, for example, repetitive printing, and if such bubbles are not expelled from the ink removal path and remain near the nozzles, there is a risk that ink discharge failure occurs. The inkjet head cleaning apparatus 1 of the present embodiment rotates the inkjet head 10 to change the orientation as described above while moving the inkjet head 10 from the printing position P1 to the cleaning position P2, and thus can promote the removal of bubbles remaining in the inkjet head 10 and can prevent discharge failure resulting from bubbles.

An excessively small rotation angle θ (see FIG. 3) of the inkjet head 10 during conveyance from the printing position P1 to the cleaning position P2 makes it difficult to obtain the effect of bubble removal by rotation, and the rotation angle is therefore preferably 45 degrees or greater, more preferably 60 degrees or greater, and even more preferably 75 degrees or greater. It is preferable that the discharge surface 12 faces vertically downward after the inkjet head 10 is rotated, and by attaining an orientation with which the nozzles become the lowermost part, it is possible to increase the flow of bubbles and facilitate removal. Although there is no particular upper limit to the rotation angle θ, the rotation angle θ is preferably 90 degrees or less because it is preferable that the inkjet head 10 when printing is in such an orientation that the discharge surface 12 faces obliquely downward as described above. In the present embodiment, the rotation angle θ is set at about 85 degrees.

The cleaning device 30 is placed near the cleaning position P2. The cleaning device 30 is supported by the rods of a cylinder 31 in a vertically movable manner, and when the inkjet head 10 is conveyed to the cleaning position P2, it is possible to raise the cleaning device 30 close to the discharge surface 12 of the inkjet head 10.

Figure 4:
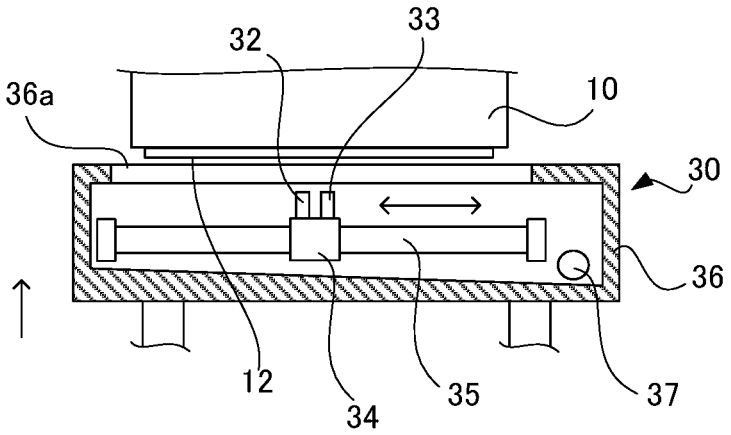
FIG. 4 is a cross-sectional view of principal parts of the inkjet head cleaning apparatus shown in FIG. 1.

FIG. 4 is a cross-sectional view of the cleaning device 30. In the cleaning device 30, a cleaning member 34 comprising a cleaning solution nozzle 32 and an air nozzle 33 is placed inside a casing 36 so as to be movable in a horizontally reciprocal manner by a robo cylinder 35. The upper part of the casing 36 has an opening 36*a*, and sequentially discharging a cleaning solution and air from the cleaning agent nozzle 32 and the air nozzle 33 while causing the cleaning member 34 to reciprocate makes it possible to spray the cleaning solution and air onto the discharge surface 12 of the inkjet head 10 in sequence. The lower part of the casing 36 has a suction port 37 connected to a suction device that is not shown, and ink and foreign matter floating or remaining in the casing 36 can be recovered together with the cleaning solution from the suction port 37.

In this way, by changing the orientation of the inkjet head 10 in the printing position P1 and in the cleaning position P2, the inkjet head cleaning apparatus 1 of the present embodiment is capable of preventing discharge failure resulting from bubbles retained in the inkjet head 10. Furthermore, by cleaning the discharge surface 12 of the inkjet head 10 with the cleaning device 20 in the cleaning position P2, the discharge failure resulting from clogged nozzles and grime can be prevented. Therefore, the discharge failure of the inkjet head 10 can be reliably prevented.

The inkjet head 10 cleaned in the cleaning position P2 is capable of successively performing printing when moved back to the printing position P1 and rotated. In the case where printing is not performed for a while, for example, at night or during a break, it is possible to move the inkjet head 10 to the storage position P3 and store it upright as it is without changing the orientation.

The storage tool 40 is placed in the storage position P3. The storage tool 40 is supported by the rods of a cylinder 41 in a vertically movable manner, and when the inkjet head 10 is conveyed to the storage position P3, it is possible to raise the storage tool 40 close to the discharge surface 12 of the inkjet head 10.

Figure 5:
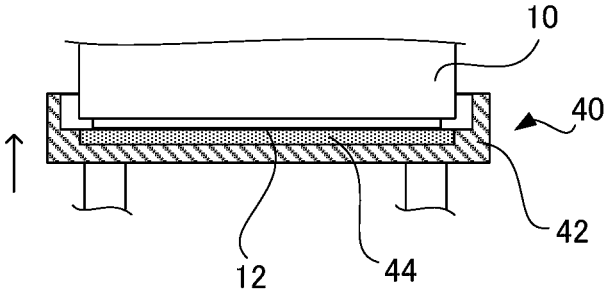
FIG. 5 is a cross-sectional view of other principal parts of the inkjet head cleaning apparatus shown in FIG. 1.

FIG. 5 is a cross-sectional view of the storage tool 40. In the storage tool 40, an absorber 44 such as a cloth or sponge impregnated with a storage solution is accommodated in a container 42 that has an opening in the upper part. The absorber 44 can be brought into contact with the discharge surface 12 of the inkjet head 10 by raising the storage tool 40. The storage solution is a liquid that can permeate the nozzles to prevent ink from drying and solidifying, and, for example, a liquid that contains the same components as ink is usable. By storing the inkjet head 10 in the storage position P3, there is no risk of nozzles becoming clogged due to dried ink even when the inkjet head 10 is kept unused for a long period of time, and discharge failure can be reliably prevented. When the inkjet head 10 is moved back to the printing position P1 from the storage position P3 to resume printing, it is preferable to clean the discharge surface 12 in the cleaning position P2 on the way.

Figure 6:
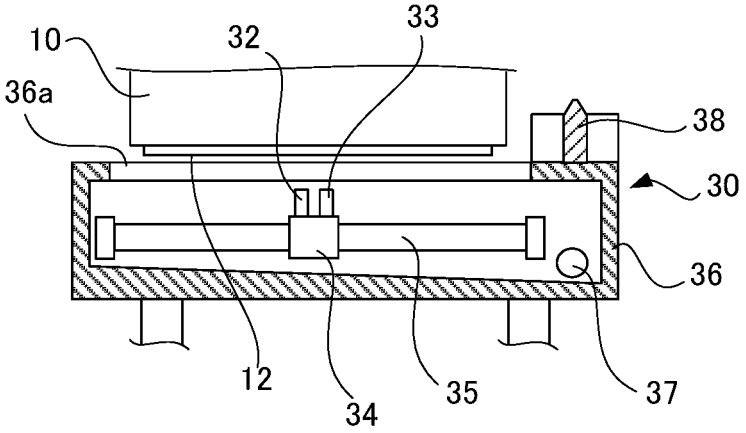
FIG. 6 is a cross-sectional view of principal parts, showing a modification to FIG. 4.
Figure 7:
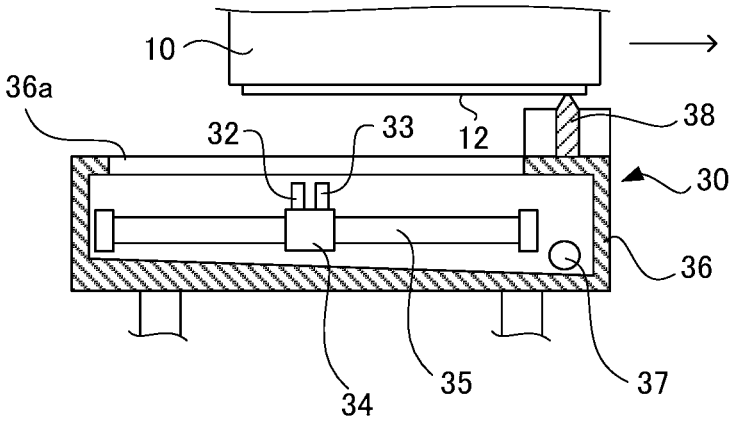
FIG. 7 is a cross-sectional view of principal parts for explaining the operation of the configuration shown in FIG. 6.

One embodiment of the present invention has been described in detail above, but the specific aspects of the present invention are not limited to the above embodiment. For example, the cleaning device 30 shown in FIG. 4 may comprise a blade-like scraping member 38 made of silicone rubber or the like on top of the casing 36 as shown in FIG. 6. According to this configuration, it is possible that after a cleaning solution and air are sequentially sprayed from the nozzles 32, 33 onto the discharge surface 12 of the inkjet head 10, the inkjet head 10 is moved to bring the discharge surface 12 into contact with the upper end of the scraping member 38 as shown in FIG. 7, and, in this state, the inkjet head 10 is horizontally moved in the direction indicated by the arrow. Accordingly, even when a deposit such as water droplets of the cleaning solution remains on the cleaned discharge surface 12, this deposit can be scraped off by the scraping member 38, and it is thus possible to reliably prevent the attachment of a deposit such as water droplets to printing substrates such as tablets in the subsequent printing step.

Figure 8:
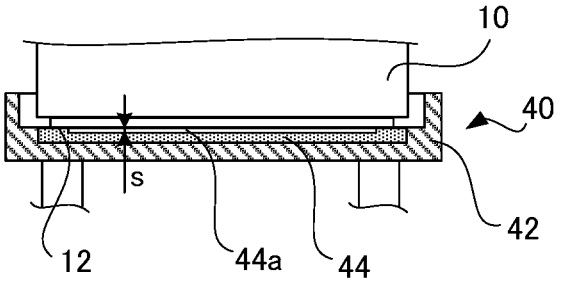
FIG. 8 is a cross-sectional view of principal parts, showing a modification to FIG. 5.
Figure 9:
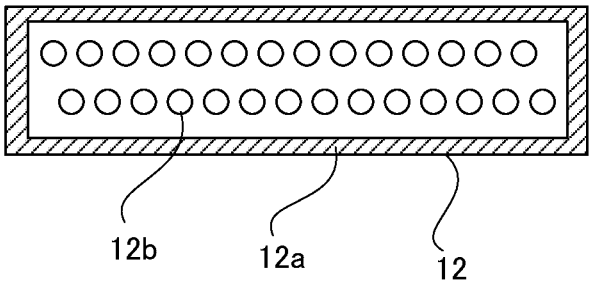
FIG. 9 is a bottom view of principal parts for explaining the operation of the configuration shown in FIG. 8.

Moreover, the absorber 44 shown in FIG. 5 may have a recess 44*a* in the center as shown in the cross-sectional view of FIG. 8. This absorber 44 can be made of, for example, silicone rubber, and the recess 44*a* can be tightly closed by bringing the portion surrounding the recess 44*a* into contact with an outer edge 12*a* (the shaded part of FIG. 9) of the discharge surface 12 of the inkjet head 10 shown in the bottom view of FIG. 9. According to this configuration, even when the storage solution is pigment ink, it is possible to prevent pigment particles from attaching and remaining near nozzles 12*b* of the discharge surface 12 and also prevent drying inside the nozzles 12*b*. Space S formed between the discharge surface 12 and the bottom surface of the recess 44*a* when the recess 44*a* is tightly closed can be set at, for example, about 0.5 mm.

REFERENCE SIGNS LIST

1 Inkjet head cleaning apparatus
10 Inkjet head
12 Discharge surface
20 Conveying device
30 Cleaning device
40 Storage tool
32 Absorber
P1 Printing position
P2 Cleaning position
P3 Storage position

The invention claimed is:

1. An inkjet head cleaning apparatus that moves an inkjet head from a printing position to a cleaning position to perform cleaning, the inkjet head cleaning apparatus comprising:

a conveying means for conveying the inkjet head between the printing position and the cleaning position that are respectively arranged as carrying positions in a horizontal direction; and a cleaning means for cleaning a discharge surface of the inkjet head conveyed to the cleaning position, wherein the conveying means changes orientation of the inkjet head such that the orientation of the discharge surface of the inkjet head is different in the printing position and in the cleaning position, and the conveying means supports the inkjet head in a horizontally movable manner and also in a rotatable manner and rotates the inkjet head while horizontally moving the inkjet head from the print position to the cleaning position.

2. The inkjet head cleaning apparatus according to claim 1, wherein the conveying means supports the inkjet head such that the discharge surface faces obliquely downward in the printing position and vertically downward in the cleaning position.

3. The inkjet head cleaning apparatus according to claim 1, wherein the conveying means rotates the inkjet head 45 degrees or greater while horizontally moving the inkjet head from the printing position to the cleaning position.

4. The inkjet head cleaning apparatus according to claim 1, wherein the cleaning means comprises a scraping member with which the discharge surface is capable of coming into contact, and with the scraping member being in contact with the discharge surface after cleaning, it is possible to scrape off a deposit on the discharge surface by horizontally moving the inkjet head.

5. The inkjet head cleaning apparatus according to claim 1, further comprising a storage means comprising an absorber impregnated with a storage solution, wherein the conveying means conveys the inkjet head to a storage position to bring the discharge surface into contact with the absorber of the storage means.

6. An inkjet head cleaning apparatus that moves an inkjet head from a printing position to a cleaning position to perform cleaning, the inkjet head cleaning apparatus comprising:

a conveying means for conveying the inkjet head between the printing position and the cleaning position;

a cleaning means for cleaning a discharge surface of the inkjet head conveyed to the cleaning position; and a storage means comprising an absorber impregnated with a storage solution, wherein the conveying means changes orientation of the inkjet head such that the orientation of the discharge surface of the inkjet head is different in the printing position and in the cleaning position, the conveying means conveys the inkjet head to a storage position to bring the discharge surface into contact with the absorber of the storage means, and wherein the absorber has a recess in center, and the recess is tightly closed by bringing a portion surrounding the recess into contact with the discharge surface.

7. An inkjet head cleaning method by which an inkjet head is moved from a printing position to a cleaning position to perform cleaning, the method comprising:

a conveying step of conveying the inkjet head between the printing position and the cleaning position that are respectively set as carrying positions in a horizontal direction; and a cleaning step of cleaning a discharge surface of the inkjet head conveyed to the cleaning position, wherein in the conveying step, the inkjet head is rotated while horizontally moving the inkjet head from the print position to the cleaning position such that the orientation of the discharge surface of the inkjet head is different in the printing position and in the cleaning position.

* * * * *